US009943942B2

(12) United States Patent
Raczuk

(10) Patent No.: US 9,943,942 B2
(45) Date of Patent: Apr. 17, 2018

(54) HAND OPERATED SURFACING TOOL

(71) Applicant: Richard C. Raczuk, Lake Havasu, AZ (US)

(72) Inventor: Richard C. Raczuk, Lake Havasu, AZ (US)

( * ) Notice: Subject to any disclaimer, the term of this patent is extended or adjusted under 35 U.S.C. 154(b) by 147 days.

(21) Appl. No.: 14/056,650

(22) Filed: Oct. 17, 2013

(65) Prior Publication Data

US 2015/0111475 A1 Apr. 23, 2015

(51) Int. Cl.
*B24B 9/00* (2006.01)
*B21D 41/02* (2006.01)

(52) U.S. Cl.
CPC ..... *B24B 9/007* (2013.01); *B21D 41/021* (2013.01)

(58) Field of Classification Search
CPC ..... B24B 9/007; B24B 5/40; B24B 23/08; B21D 41/021
USPC ..... 451/51, 252, 61, 180, 557, 558, 541; 241/439
See application file for complete search history.

(56) References Cited

U.S. PATENT DOCUMENTS 1,075,198 A * 10/1913 Crockatt ..... 408/83.5
1,534,908 A * 4/1925 Browder ..... B23B 5/163 408/104
1,795,358 A * 3/1931 Arndt ..... B21D 41/023 72/124
1,950,154 A 3/1934 Rosenberg et al.
2,117,543 A * 5/1938 Corrigan ..... B21D 41/00 72/317
2,744,307 A * 5/1956 Smiley ..... B23B 5/168 29/57
2,852,839 A * 9/1958 Wilson ..... 269/9
3,712,174 A * 1/1973 Granfield ..... 409/138
3,807,051 A 4/1974 Funakubo
4,027,992 A 6/1977 Mackey, Sr. et al.
4,047,415 A * 9/1977 Crane ..... B21D 41/00 72/125
4,483,222 A 11/1984 Davis
4,486,129 A 12/1984 Vowel
4,504,178 A * 3/1985 Seidenfaden ..... B23C 3/126 144/154.5
4,615,243 A 10/1986 Davis
5,088,169 A * 2/1992 Touzet ..... B23B 5/168 86/19.7
5,497,539 A * 3/1996 Blodgett ..... B23B 5/168 408/112
6,397,718 B2 * 6/2002 Jamison et al. ..... 86/19.7
6,487,947 B1 * 12/2002 Clai ..... 82/113
7,662,026 B2 * 2/2010 Lewis ..... B24B 15/00 408/83.5

(Continued)

FOREIGN PATENT DOCUMENTS

JP 08108370 A * 4/1996

*Primary Examiner* — Monica Carter
*Assistant Examiner* — Lauren Beronja
(74) *Attorney, Agent, or Firm* — Taft Stettinius & Hollister LLP

(57) ABSTRACT

The present disclosure defines a hand operated grinding tool for finishing an interface surface of a fluid conduit. The grinding tool includes a fixture having grinding tool yoke and a work piece yoke. A shaft with a tool head connected to one end and an actuator connected to the other end is configured to slide and rotate relative to the grinding tool yoke. The tool head can be configured to engage and finish a surface of a tube and/or a male fitting.

33 Claims, 9 Drawing Sheets

(56) References Cited

U.S. PATENT DOCUMENTS

2004/0179907 A1 9/2004 MacDuff

* cited by examiner

HAND OPERATED SURFACING TOOL

TECHNICAL FIELD

The present invention relates to an apparatus for grinding a portion of an interface surface of a fluid conduit, and more particularly to grinding, lapping or otherwise finishing flared surfaces of tubes and fittings with a surfacing tool to facilitate fluid tight connections therebetween.

BACKGROUND

Some fluid conduits such as tubes with flared ends fail to make fluid tight connections with fluid fittings, connectors and the like. One particular problem associated with conduits that have fluid leaks is inadequate surface finishing which can lead to fluid leakage from connected conduits. The present invention addresses the problems associated with some prior art fluid conduits.

SUMMARY

One embodiment of the present disclosure is a unique apparatus and method for grinding, lapping, smoothing or otherwise forming a finished surface capable of creating a fluid tight connection between conduits. Other embodiments include apparatuses, systems, devices, hardware, methods, and combinations for the same. Further embodiments, forms, features, aspects, benefits, and advantages of the present application shall become apparent from the description and figures provided herewith.

BRIEF DESCRIPTION OF THE FIGURES

The description herein makes reference to the accompanying drawings wherein like reference numerals refer to like parts throughout the several views, and wherein.

DETAILED DESCRIPTION OF THE ILLUSTRATIVE EMBODIMENTS

Figure 1:
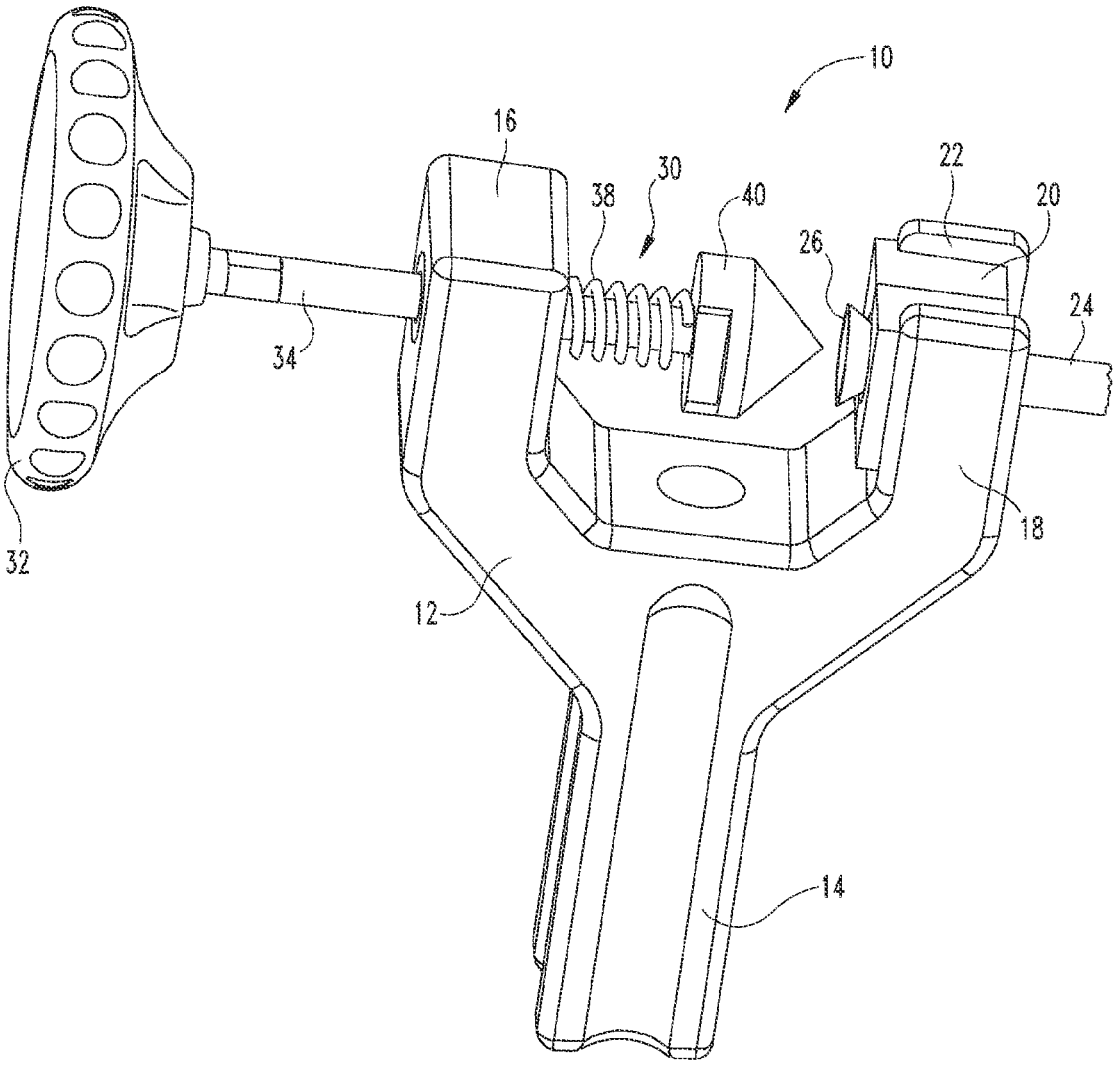
FIG. 1 is a perspective view of a hand operated grinding apparatus.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. It should also be understood that when the term "grinding" is used throughout this disclosure the term is merely used for convenience and should not be construed as limiting the scope of the disclosure. The term "grinding" includes any material removing or finish surfacing techniques such as, but not limited to lapping, polishing, or otherwise smoothing a surface of a work piece such as a flared surface of a fluid fitting to form a fluid tight sealing surface with a coupled fluid conduit.

Referring to FIG. 1, a hand operated grinding apparatus 10 is illustrated therein. The hand operated grinding apparatus 10 can be configured to finish interface surfaces of work pieces or fluid conduits such as a double flare brake line for a vehicle or other applications. In one form, the apparatus 10 is portable and can be used to surface brake lines, tubes and fittings that remain attached to a vehicle. The hand operated grinding apparatus 10 can include a fixture 12 having a base 14 extending to a grinding tool yoke 16 on one side and a work piece yoke 18 on an opposing side of the hand operated grinding apparatus 10. A work piece collet 20 can be releasably engaged with a collet holding portion 22 formed in the work piece yoke 18. The work piece collet 20 can be configured to hold a work piece in a fixed position relative to the work piece yoke 18. In an exemplary embodiment, the work piece is a tube 24 with a flared end 26, however the present disclosure should not be limited to any particular embodiment shown in the drawings. As such, any work piece having a surface that can be finished through a grinding, polishing, lapping or any other surface smoothing technique can be utilized with the present disclosure as described and claimed herein. On the other side, a grinding tool 30 can be operably coupled with the grinding tool yoke 16 of the apparatus 10. The grinding tool 30 can include a hand actuator that is gripable by an operator such as a hand wheel 32 connected to one end of a primary drive grinding tool shaft 34. A grinding head 40 can be connected to the other end of the grinding tool shaft 34. An optional biasing member 38 such as a coil spring or other force generating mechanism can be positioned between the grinding tool yoke 16 and the grinding head 40.

Figure 2:
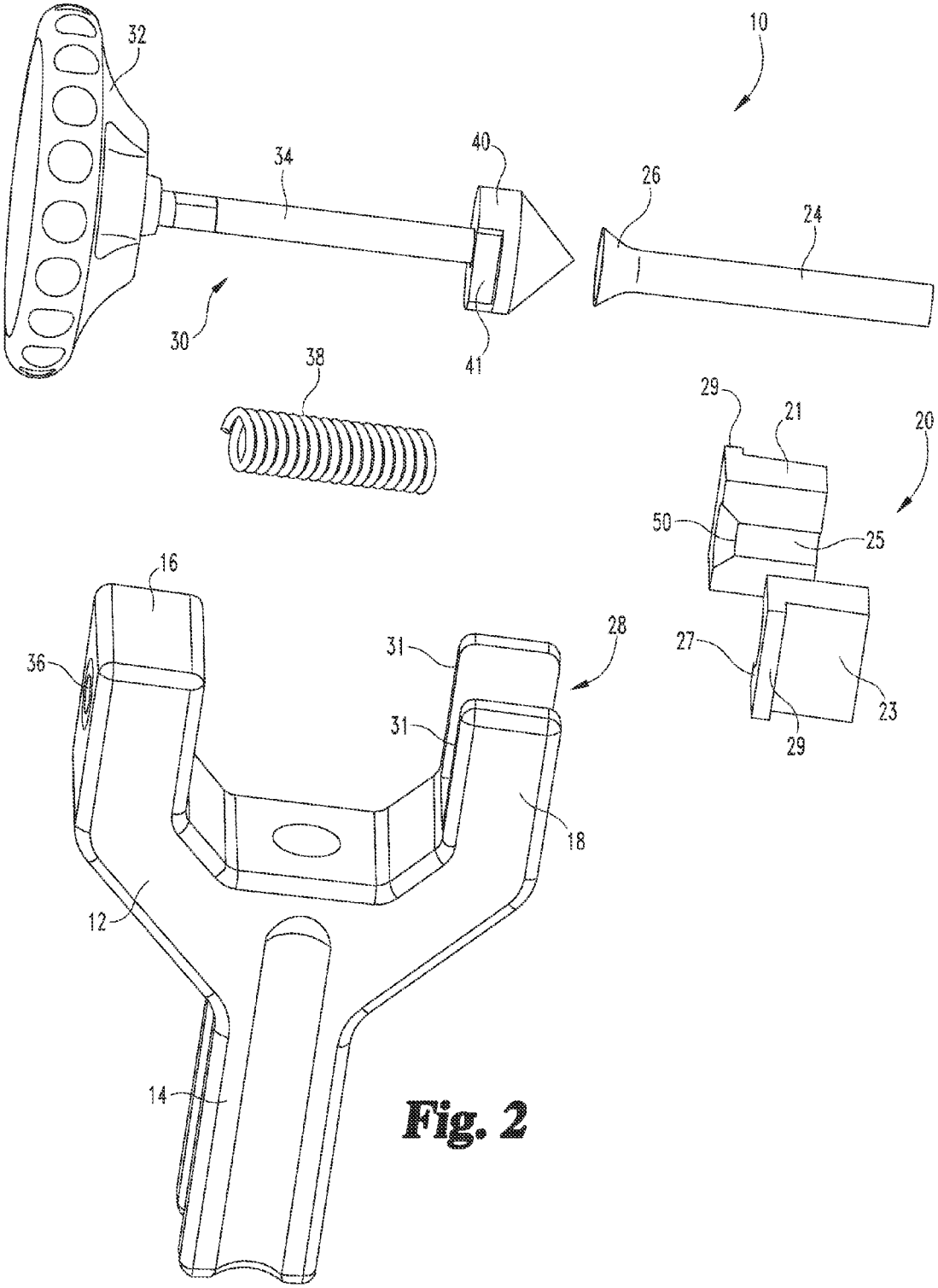
FIG. 2 is an exploded view of the hand operated grinding apparatus of FIG. 1.

Referring now to FIG. 2, the hand operated grinding apparatus 10 is shown in an exploded view to more particularly illustrate the features of the apparatus 10. In one form, the hand operated grinding apparatus 10 is configured to receive the shaft 34 of the grinding tool 30 through an aperture 36 formed in the grinding tool yoke 16. The shaft 34 can be positioned through the aperture 36 and the hand wheel 32 can then be attached to one end thereof through threaded means or other mechanical fastening means as would be known to one skilled in the art. The grinding head 40 can be attached to the shaft 34 of the grinding tool 30 either before or after the shaft 34 is positioned through the aperture 36. The grinding head 40 can be attached to the shaft 34 via threaded means, press fit, welding, or other mechanical techniques. One or more coupling enabling features such as a flat 41 can be formed on the grinding head 40 to facilitate a connection surface for a wrench to engage therewith. Alternatively, the grinding head 40 and grinding tool shaft 34 can be formed as an integral single piece construction though a casting, forging and/or machining processes. In the exemplary drawing, the outer diameter of the grinding head 40 is shown as larger than the outer diameter of the grinding tool shaft 34. However it should be understood that this is for illustrative purposes only and the outer diameter of the grinding head 40 can be the same as or even smaller than that of the shaft 34 in some embodiments. The biasing member 38 can be positioned between the grinding head 40 and the grinding tool yoke 16 in a manner that urges the grinding head 40 toward the work piece yoke 18.

The work piece collet 20 can include internal features 50 that correspond to the size and shape of a work piece such as the flared tube 24 illustrated in this exemplary drawing. The tube 24 can be positioned within the collet 20 and clamped together such that the tube 24 cannot be pulled through the collet 20 when the collet 20 is operationally coupled to the work piece yoke 18. In one form, the collet 20 can be formed of two or more opposing clam shell portions 21, 23 and in another form, the collet 20 can simply be formed as a single one piece construction that permits the work piece to slide through an opening 25 until a protruding feature on the work piece abuts a wall 27 of the collet 20. The collet 20 with the tube 24 inserted therein can be coupled to the work piece yoke 18 by sliding engagement with a channel 28 formed in the work piece yoke 18. The collet 20 can be held in channel 28 through frictional fit or alternatively with threaded fasteners (not shown) or the like. A flange 29 extending from a wall 27 of the collet 20 can abut against a face 31 of the channel 28 when the collet 20 is positioned therein. The force of the grinding tool 30 applied to the work piece and collet 20 during operation will tend to urge the collet 20 into the channel 28 so as to prevent the collet 20 from disengaging from the channel 28 of the work piece yoke 18. Other forms of containment of the collet 20 are contemplated by the present disclosure including, but not limited to threaded fasteners, clips, pins and the like. It should be noted that in some embodiments of the present disclosure that a collet 20 may not be used with the apparatus 10. In such embodiments, the work piece yoke 18 may be formed in such a way as to permit direct engagement with and holding of a work piece to be finished with a grinding tool 30.

Figure 3:
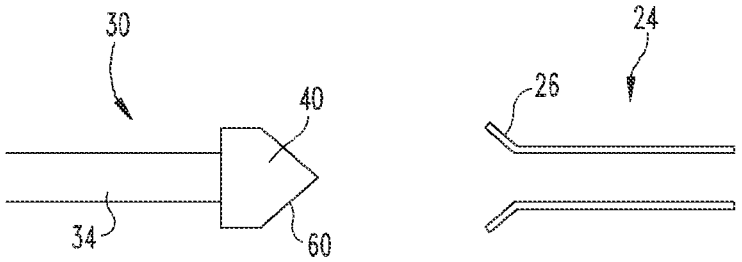
FIG. 3 is a schematic cross-sectional representation of a tube grinding tool and a tube with a flared end.

Referring now to FIG. 3, a schematic representation of a portion of the grinding tool 30 and the flared tube 24 is illustrated therein. The shaft 34 of the grinding tool 30 can include an outer layer of bearing material or a coating such as a solid lubrication coating or an anti-fret coating applied to the external surface thereof to permit sliding and rotating engagement through the aperture 36 of the grinding tool yoke 16 while minimizing wear to the shaft 34. In addition to or in lieu of a bearing or coating material placed on the shaft 34, the aperture 36 of the grinding tool yoke 16 can include a bearing or bushing material such as a pressed in bearing insert or the like. The bearing material can be formed from any material combination as known to those skilled in the art. In one aspect, the bearing material and can include bronze, tin, copper or other combinations of suitable material. The tool head 40 can be formed from a hardened steel, metal alloy, ceramic, or other suitable combinations of materials. The tool head 40 can include a hardened working surface 60 that has a complimentary shape to a surface of a work piece such as the flared end 26 of the tube 24. In the exemplary embodiment the tool head 40 includes a generally conically shaped working surface 60, however in other embodiments a working surface 60 having different shapes is contemplated. The hardened working surface 60 can include material addition such as diamond particles, diamond dust, cubic boron nitride abrasive particles or other abrasive materials having a ceramic or carbon particle base to facilitate a grinding operation. Optionally, dry lubrication material such as graphite can be added to the working surface 60 to promote a dry grinding operation. As described above, the grinding tool shaft 34 and grinding head 40 can be made as separate components and with optional separate material compositions or alternatively can be formed as a single one piece component through casting or forged billet material.

Figure 4:
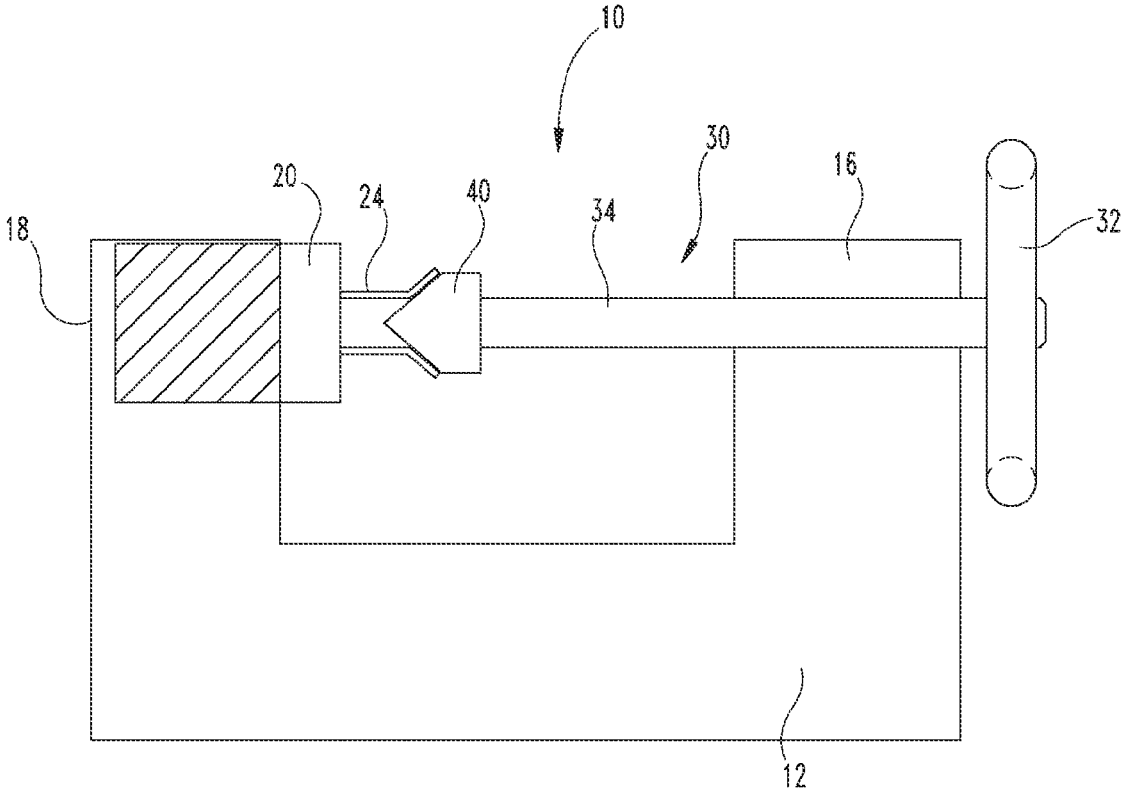
FIG. 4 is a schematic cross-sectional view of the grinding apparatus with a grinding tool engaged with a flared end of a tube.

Referring now to FIG. 4, a hand operated grinding apparatus 10 is shown in a schematic view wherein the grinding tool shaft 34 of the grinding tool 30 is engaged with the grinding yoke 16 and is positioned such that the grinding head 40 is engaged with the flared end 26 of the tube 24. In this position, the hand wheel 32 can be rotated in one direction and/or in alternating rotational directions in order to grind, smooth or otherwise form a desired surface profile for the flared end 26 so that a fluid tight coupling can be achieved between the tube 24 and a fitting or other component.

Figure 5:
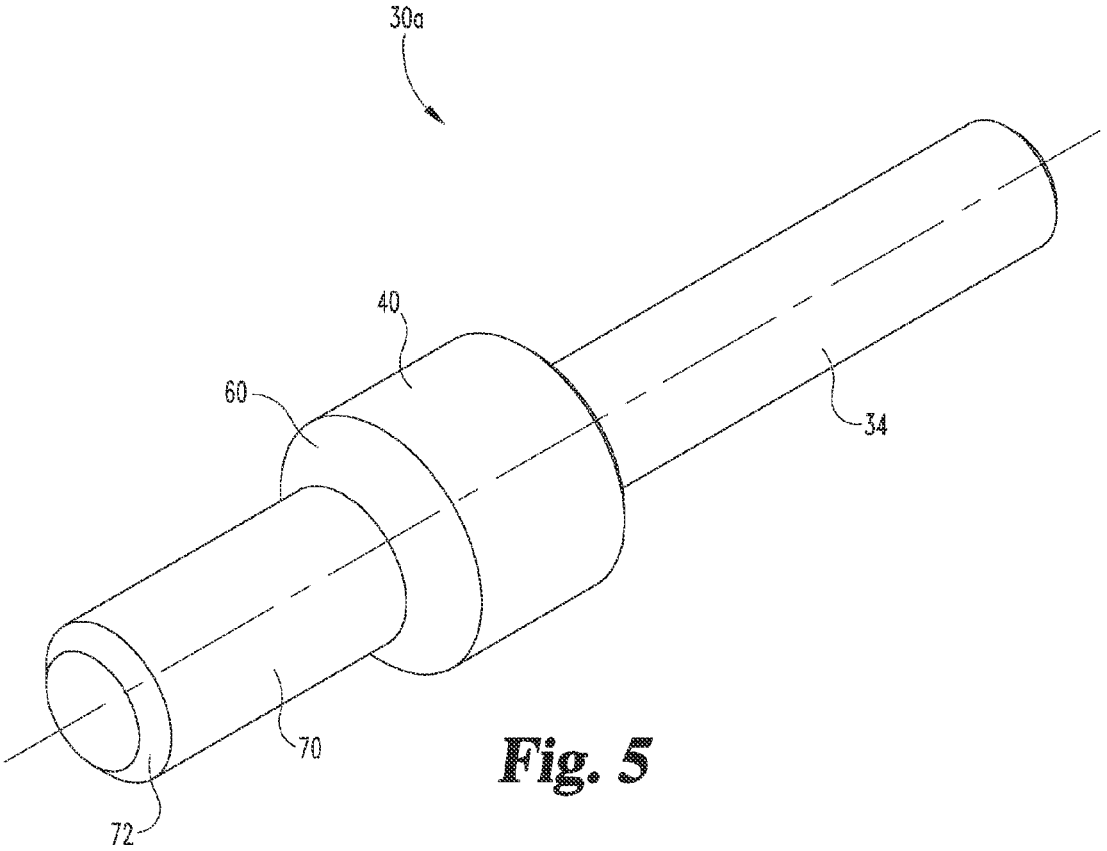
FIG. 5 is a perspective view of an alternate embodiment of a tube grinding tool.

Turning now to FIG. 5, an alternate embodiment of a grinding tool **30*a* is illustrated therein. The alternate grinding tool 30*a* includes a grinding tool shaft 34 connected to a grinding tool head 40 with a working surface 60 similar to the previous grinding tool 30. A centering rod 70 can extend from the grinding tool head 40 in an opposite direction to that of the shaft 34. The centering rod 70 can include a lead-in chamfer 72 or other features to help locate the centering rod 70 within a corresponding tube. The centering rod 70 can help center or align the grinding tool 30*a*** with respect to a tube (not shown) having a surface to be finished.

Figure 6:
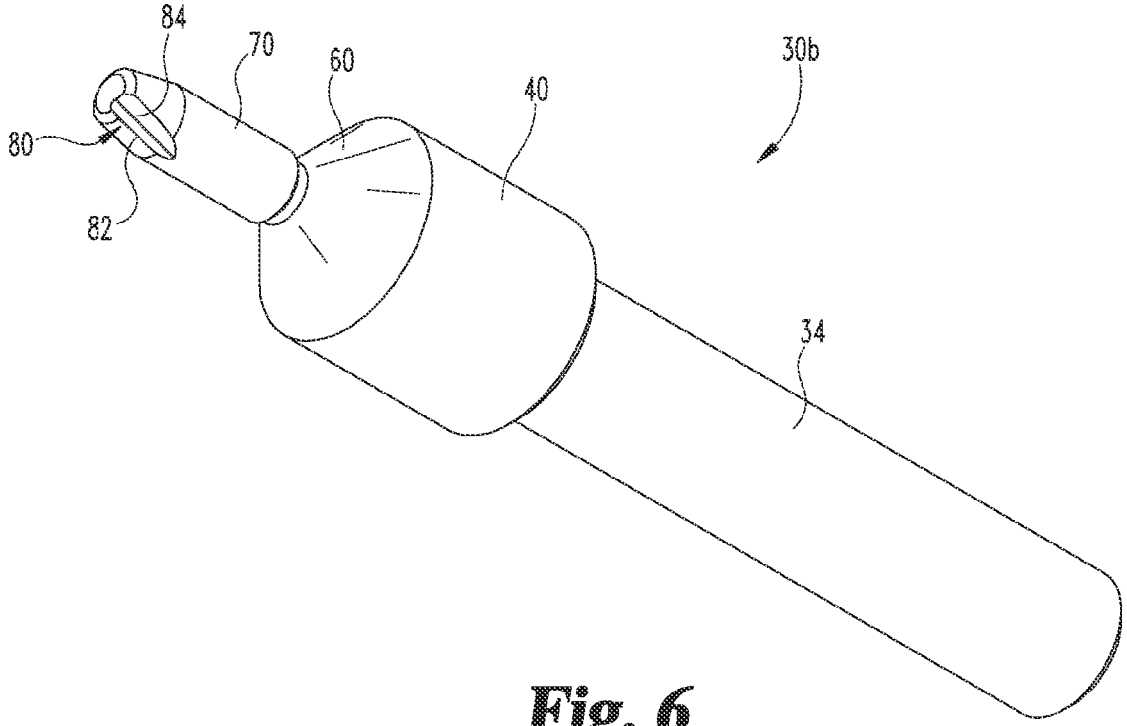
FIG. 6 is a perspective view of yet another embodiment of a tube grinding tool.

Referring now to FIG. 6, yet another embodiment of a tube grinding tool **30*b* is illustrated. The grinding tool 30*b* can include a grinding tool shaft 34 connected to a grinding tool head 40 with a working surface 60 similar to the previous embodiments of the grinding tool 30 and grinding tool 30*a*. A centering rod 70 can extend from the working surface 60 in opposite direction from that of the shaft 34 in a manner similar to the centering rod 70 of the grinding tool 30*a*. The centering rod 70 can include a cutting element 80 formed proximate one end thereof. The cutting element 80 can include a sharp cutting edge 82 that transitions into a recessed cavity 84 that is operable to hold and/or remove shaving material from the work piece that has been cut by the cutting element 80**.

Figure 7:
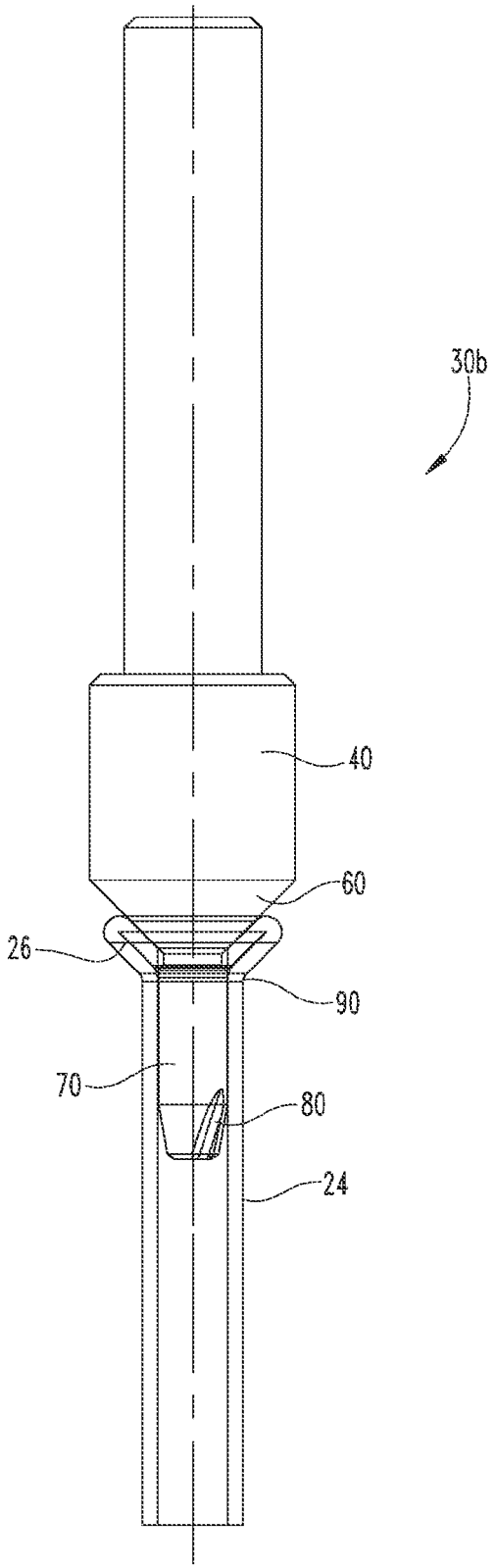
FIG. 7 is a side view of the tube grinding tool of FIG. 6 engaged with a flared tube partially cut away.

FIG. 7 shows an operational view of the grinding tool **30*b* engaged with a tube 24. The centering rod 70 extends through the center of the tube 24 and the cutting element 80 can be used to remove material in a throat area 90 of the tube 24. Material removal can be required in some tubes if the throat has material that protrudes inward from the inner diameter of the tube 24 and restricts the centering rod 70 from passing therethrough. The cutting element 80 can be used to remove an amount of material necessary to provide access for the centering rod 70 to slide into the tube 24 and permit the working surface 60 of the grinding head 40 to engage with the flared end 26 of the tube 24. The working surface 60 can then be rotated in one direction and/or in alternating opposite directions so as to form a desired surface finish on flared end 26** that is capable of providing a fluid tight seal with a fitting or a connector.

Figure 8:
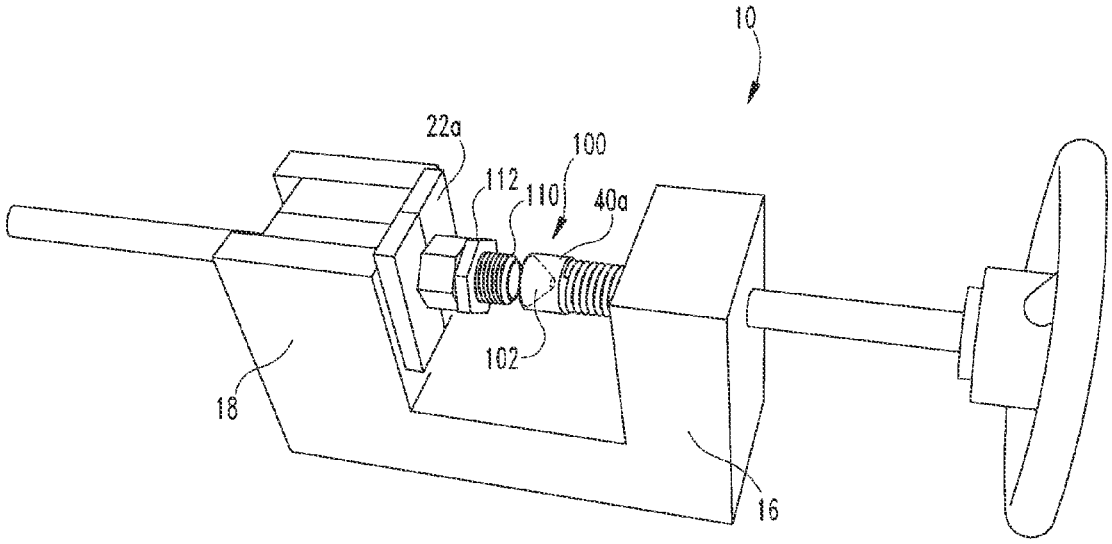
FIG. 8 is a schematic perspective view of a hand operated grinding apparatus having a grinding tool configured to grind a flared end of a male fitting.

Referring now to FIG. 8, a hand operated grinding apparatus 10 is shown in yet another embodiment. The figure illustrates a male work piece grinding tool 100 that includes a working surface 102 configured to grind a flared end 110 of a male fitting 112. A collet 20*a* can threadingly receive the male fitting 112. The collet 20*a* can be adapted to engage with the work piece yoke 18 similar to the work piece collet 20 used to hold a flared tube 24. The male grinding tool 100 is used in a similar fashion to the tube grinding tool described previously. A working or grinding head 40*a* can be engaged with the flared end 110 of the male fitting 112 and rotated in one and/or alternate opposing directions until the surface finish of the flared end 110 of the male fitting 112, including roughness and flatness, meets a desired criteria.

Figure 9:
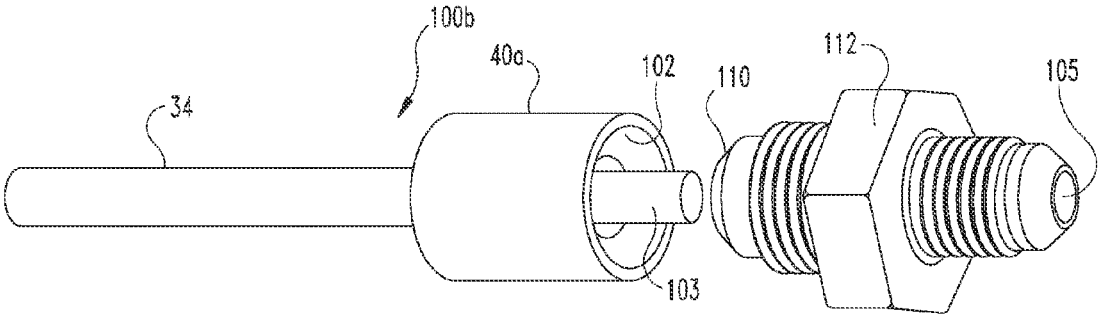
FIG. 9 is a perspective view of an alternate embodiment of a grinding tool with a centering rod configured to grind a flared end of a male fitting.

Referring now to FIG. 9, an alternate embodiment of a male grinding tool 100*b* includes a working head 40*a* with an inverse flared surface 102 for grinding the surface 110 of a male fitting 112 is illustrated. The male grinding tool 100*b* can include a centering rod 103 extending from the working head 40*a* opposite of the grinding tool shaft 34. The centering rod 103 is sized to sliding engage within a through hole 105 formed in the male fitting 105. Once the centering rod 103 is engaged with the through hole 105 the working head 40*a* will be properly aligned with the flared surface 110 of the male fitting 112 and thereby facilitating a precisely finished flared surface 110 with the grinding tool 100*b*. The centering rod 103 can be rotated and longitudinally slid within the through hole 105 during a surface finishing procedure.

Figure 10:
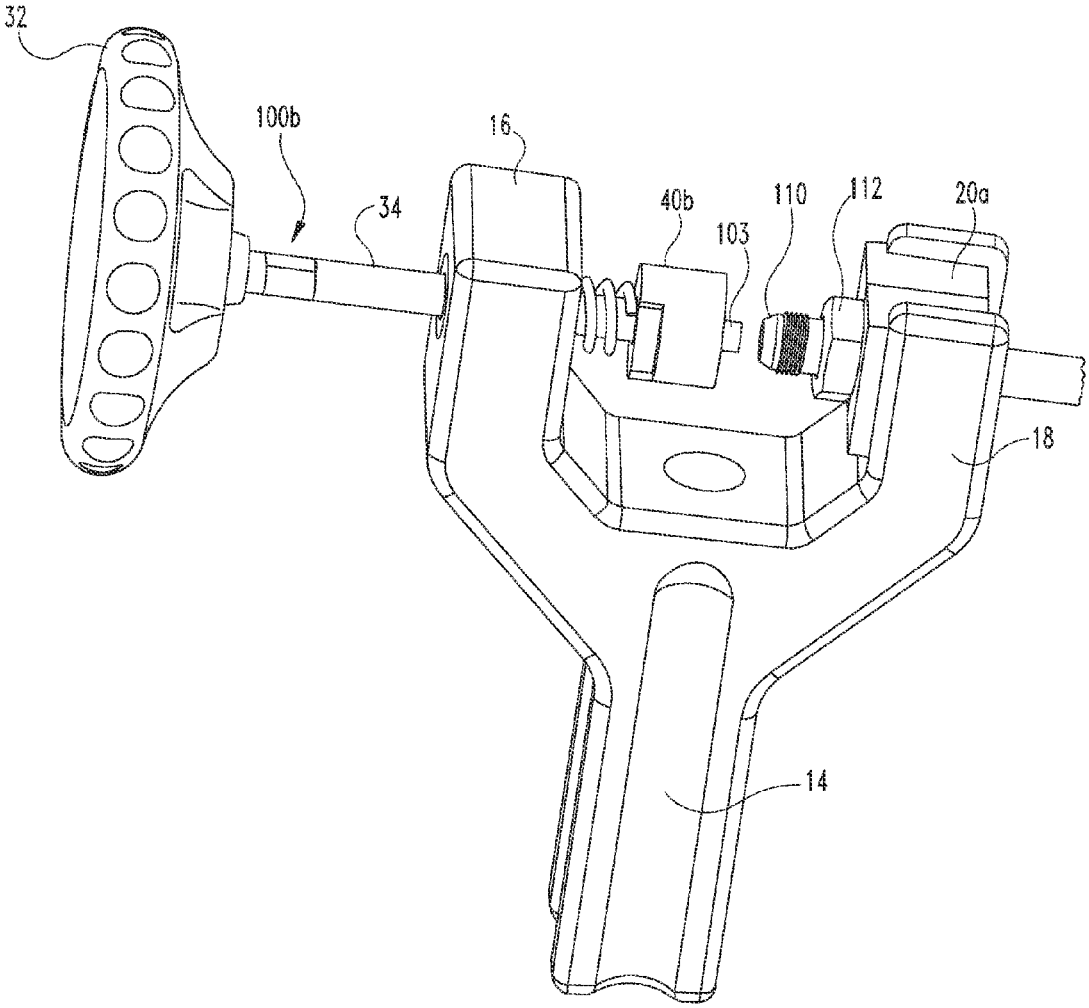
FIG. 10 is a perspective view of a hand operated grinding apparatus with the male grinding tool of FIG. 9.

Referring now to FIG. 10, a hand operated grinding apparatus 10 is shown with the male grinding tool 100*b* assembled with the grinding tool yoke 16. A collet 20*a* can threadingly receive the male fitting 112 to hold the fitting 112 with respect to the apparatus 10. The collet 20*a* can be adapted to fixedly engage with the work piece yoke 18 similar to the work piece collet 20 used to hold a flared tube 24. The working or grinding head 40*a* can be aligned with the fitting 112 by engaging the centering rod 103 within the through hole 105 of the fitting 112 and the flared grinding surface 102 can then provide a desired surface finish to the flared end surface 110 of the male fitting 112 when the hand actuator 32 is rotated in one and/or alternate opposing directions while in the grinding surface 102 is in contact with the flared surface 110.

Figure 11:
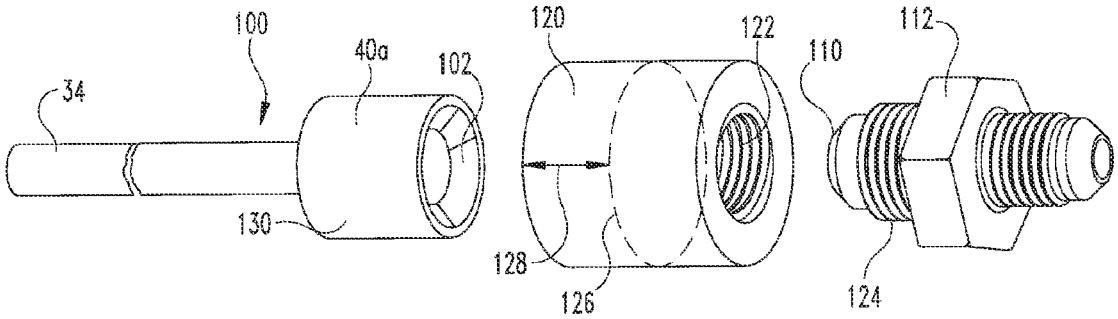
FIG. 11 is a perspective view of an alternate embodiment of a grinding tool with a tool head guide configured to grind a flared end of a male fitting.

Referring now to FIG. 11, yet another embodiment is depicted of a male grinding tool 100 includes a working head 40*a* with an inverse flared surface 102 for grinding the surface 110 of a male fitting 112. The male grinding tool 100 is similar to the tool 100 shown in FIG. 8, however in this embodiment a guide cylinder 120 is utilized to align the grinding tool 100 with the male fitting 112. The guide cylinder 120 can include threads 122 for threadingly engaging with coupling threads 124 formed on the male fitting 112. Alternatively the guide cylinder 120 can be coupled with the collet 20 as one skilled in the art would readily understand. Threads 122 end at an intermediate position denoted by dashed line 126 and a smooth bore on the inner diameter of the guide cylinder 120 is formed along the guide portion denoted by arrow 128. This inner diameter of the guide portion 128 of the guide cylinder 120 is configured to correspond with an outer diameter surface 130 of the grinding cylinder head 40*a*. As the tool head 40*a* is directed toward the male fitting 112, the guide cylinder 120 will align the guide head 40*a* with the flared surface 110 of the male fitting 112 and thereby facilitating a precisely finished flared surface 110. The cylindrical grinding head 40*a* can be rotated and longitudinally slid within the guide portion 128 of the guide cylinder 120 during a surface finishing procedure.

Figure 12:
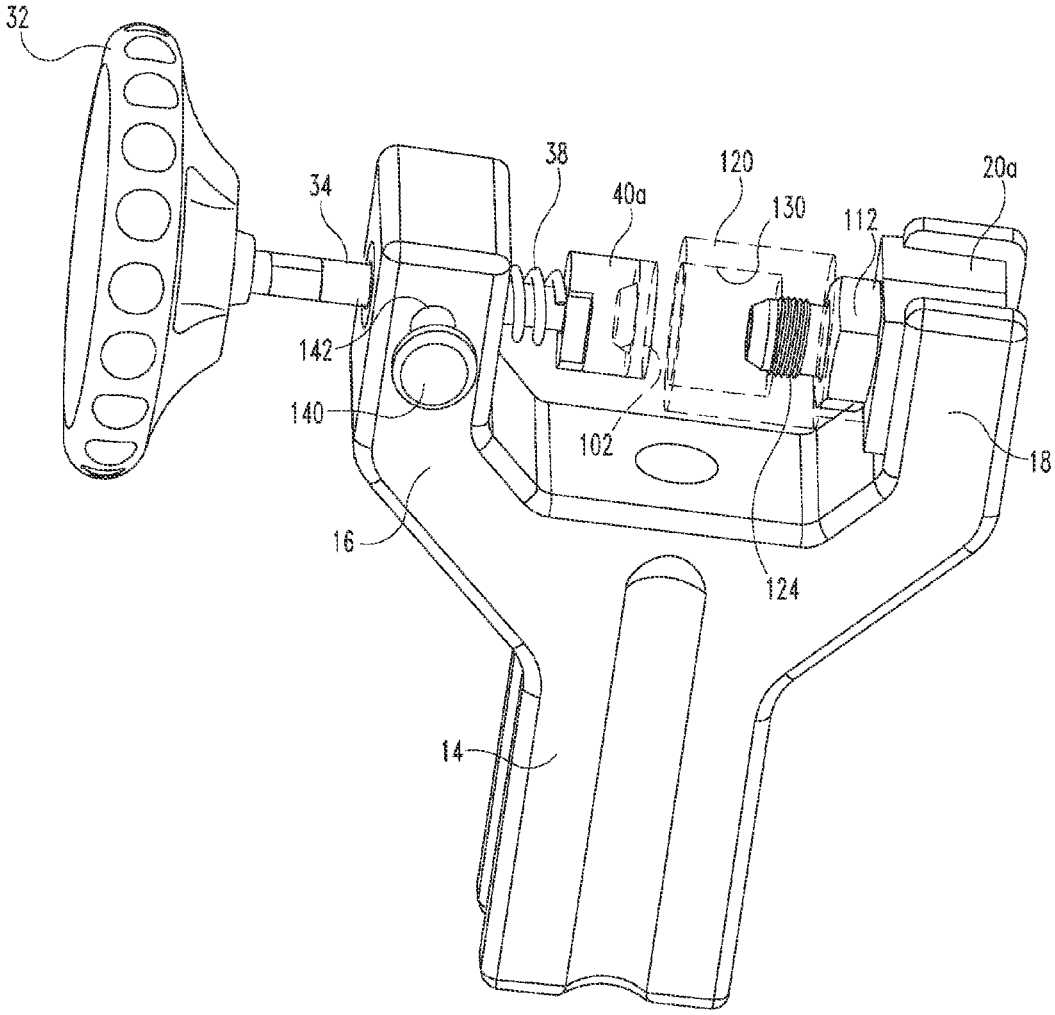
FIG. 12 is a perspective view of a hand operated grinding apparatus with the grinding tool of FIG. 11.

Referring now to FIG. 12, a hand operated grinding apparatus 10 is shown with the male grinding tool 100 assembled with the grinding tool yoke 16. A collet 20*a* can threadingly receive the male fitting 112 to hold the fitting 112 with respect to the apparatus 10. The collet 20*a* can be adapted to fixedly engage with the work piece yoke 18 similar to the work piece collet 20 used to hold a flared tube 24. The working or grinding head 40*a* can be aligned with the fitting 112 by engaging the fitting 112 through the guide portion 128 of the guide cylinder 120. The grinding head 40*a* can then provide a desired surface finish to the flared end surface 110 of the male fitting 112 when the hand actuator 32 is rotated in one and/or alternate opposing directions while the grinding surface 102 is in contact with the flared surface 110. It should be noted that while the guide cylinder 120 is depicted with reference to finishing a male fitting in the present disclosure, a guide cylinder can also be used with other grinding tool configurations such as those used for finishing female flared surfaces of tubes and the like.

A lock button 140 can be used in some embodiments of the present disclosure to lock the grinding tool 100 or the tube grinding tool 30 in a retracted position. Although the lock button 140 is only shown in the embodiment illustrated in FIG. 12, it should be understood that this feature can be used with any embodiment disclosed and/or defined by the claims of this application. The lock button 140 includes an elongate pin 142 that can extend through the grinding tool yoke 16 and engage with a portion of the shaft 34 of the grinding tool. The pin 142 can be configured to engage with features such as a groove, indentation, blind hole, through hole or any other feature that can be used to lockingly engage the shaft 34 as would be understood by one skilled in the art. The pin 142 can include shaped features (not shown) on the end thereof such as a narrowing portion or other geometric changes from that of the shape and size of the pin 142. The shaft 34 can be retracted and the lock button 140 can be depressed to engage a locking feature (not shown) formed in the shaft to hold the shaft and withstand the force of the spring 38. The lock button 140 can then retracted as desired to permit the shaft 34 to return to a spring induced forward position.

Grinding tool heads, both male and female configurations contemplated by the present disclosure can be formed in various sizes, angles and shapes to correspond to the surface configuration of a work piece that will be ground, lapped or otherwise finished. The grinding tool heads can be defined by criteria for flatness, smoothness and curvature along a longitudinal axis. Grinding heads can be designed to engage standard flare fitting styles such as a 45-degree SAE and a 37-degree AN or alternatively can be designed to engage with non-standard styles. The grinding apparatus and grinding tool, including components such as the hand actuator, shaft and grinding tool head, collet and yokes can be formed from any suitable material as desired. Material selection can include but is not limited to metals, ceramics, composites, plastics and combinations thereof. In one nonlimiting example, the grinding tool head can be made of tool steel or the like, and can be hardened through heat treat methods known to those skilled in the art. After forming the grinding head, additional material or coatings can be added through post heat treat processing. Such material addition can include diamond coatings, diamond dust, or other hardened particles as discussed previously.

It should also be understood that any feature described in this disclosure with respect to one embodiment is contemplated to apply to all other embodiments disclosed and claimed herein. A collet 20 formed of one or more pieces can be utilized to hold a tube or a fitting and the like in position relative to the work piece yoke 18. A collet 20 can also have a guide cylinder 120 connected thereto to provide alignment to the grinding tool. The connection of the collet 20 and guide cylinder 120 can be permanent such as through a weld joint or an integral formation or alternatively can be removable such as through threaded engagement or removable fasteners.

The grinding tools 30,100, 100*b* can be assembled with the grinding tool yoke 16 in a variety of ways and should not be limited by the disclosed embodiments provided herein. In one form, the shaft 34 can be extended through the aperture 36 and a biasing member 38 such as a spring can be positioned between the grinding yoke 16 and the grinding head 40. The grinding heads 40, 40*a* can then be assembled to the shaft 34 such as through internal threaded engagement or with separate fasteners, rivets or screws and the like. Alternatively, the grinding head 40 can be press fit on to the shaft 34 or formed as an integral one-piece construction with the shaft 34. After the biasing member 38 and grinding head 40 are placed on the internal portions of the shaft relative to the grinding yoke 16, the hand wheel 32 can then be attached to the other end of the shaft 34 via similar mechanical means as the grinding head 40.

The optional biasing member 38 can be designed so as to provide a desired amount of force between the grinding head 40 and the work piece in some embodiments. The operator can apply additional translational force to the work piece through an actuator member such as hand wheel 32 or other forms such as for example sliding bars or an adapter for a power rotary tool or the like. The actuator member such as hand wheel 32 can be rotated in a clockwise and/or counterclockwise direction with or without applying additional force on the work piece during a grinding operation to form a desired finish on the interface surface of the work piece. After the work piece is finished, the grinding tool can be retracted to permit the collet 20 to be removed from the work piece yoke 18. In some embodiments a lock button 140 can be depressed to lock the grinding tool in the retracted position and released as desired. In this manner, a work piece such as tubes and fittings with flared ends can be ground and finished such that fluid leaks are prevented between work piece connections.

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A hand operated surfacing tool comprising:

a base having first and second yokes extending therefrom spaced apart in a substantially U-shaped configuration;

an aperture extending through the first yoke and a collet holding region formed with the second yoke, the collet holding region defined by a pair of spaced apart uprights with a channel formed therebetween;

a grinding tool having an elongate shaft axially slidingly and rotatably engageable through the aperture of the first yoke;

a grinding tool head connected to one end of the elongate shaft;

a hand operated actuator connected to the other end of the elongate shaft operable to transmit rotational motion and axial sliding motion to the shaft; and a work piece collet having a wall with a flange extending therefrom, wherein the work piece collet slidingly engages within the channel and the flange abuts a face of at least one of the uprights of the collet holding region.

2. The hand operated surfacing tool of claim 1, wherein the work piece collet includes internal features that define a conical shape of a flared end of a work piece and is configured to hold the work piece in position to permit the grinding tool head to engage with the work piece.

3. The hand operated surfacing tool of claim 2, wherein the work piece is one of a flared tube and a male fitting with a flared end and the grinding tool is operable to grind a surface of the flared tube or male fitting to a desired surface finish.

4. The hand operated surfacing tool of claim 1, wherein the grinding tool head is formed of a different material composition than that of the elongate shaft.

5. The hand operated surfacing tool of claim 1, wherein the grinding tool head and elongate shaft are integrally formed from a single piece casting or forging.

6. The hand operated surfacing tool of claim 1, wherein the grinding tool head includes a material coating to facilitate a dry grinding operation.

7. The hand operated surfacing tool of claim 1, wherein the grinding tool head includes diamond particles positioned on a working surface thereof.

8. The hand operated surfacing tool of claim 1, wherein the grinding tool head includes a centering rod with a cutting element positioned at a distal end thereof with an outer diameter less than or equal to an outer diameter of the centering rod.

9. The hand operated surfacing tool of claim 1, wherein the actuator is operable for transmitting a force between the grinding tool head and a work piece while rotating in either a clockwise or counterclockwise direction.

10. The hand operated surfacing tool of claim 1, wherein the actuator includes a wheel connected to the shaft of the grinding tool.

11. The hand operated surfacing tool of claim 1, wherein the grinding tool head is configured to grind a portion of a work piece to a desired surface finish.

12. The hand operated surfacing tool of claim 1 further comprising:

a biasing member positioned about the elongate shaft between the first yoke and tool head for urging the tool head toward the work piece.

13. The hand operated surfacing tool of claim 1, wherein the grinding tool head is conical in shape and operable for grinding a surface of a flared brake line tube.

14. The hand operated surfacing tool of claim 1, wherein the grinding tool head is at least partially cylindrical in shape and includes a reverse flare working portion for grinding an outward facing flared surface of a male fitting.

15. The hand operated surfacing tool of claim 1 further comprising:

a lock button extending through the first yoke and selectively engaging with the grinding tool shaft to hold the shaft in a retracted position.

16. The hand operated surfacing tool of claim 1, further comprising:

a tool head guide having an internal threaded portion and an internal smooth bore portion.

17. A method for surface finishing an interface portion of a fluid conduit comprising:

positioning a conduit in fixed relation to a collet with a flange extending from an outer wall thereof;

sliding the collet through a channel formed between two uprights of a first yoke of a hand operated surfacing tool until the flange abuts a face of the uprights;

sliding a shaft with a grinding head through an aperture formed in a second yoke of the hand operated surfacing tool;

wherein an open space is formed between the first and second yokes; and sliding the grinding head across the open space and rotating the grinding head against the interface portion of the fluid conduit until a desired surface finish is formed on the interface portion.

18. The method of claim 17, wherein the rotating is generated by hand actuation of a wheel connected to the shaft.

19. The method of claim 17, wherein the rotating alternates between a clockwise and a counterclockwise direction while the grinding head is engaged with the interface portion.

20. An apparatus comprising:

a fixture having a grinding tool yoke and a work piece yoke spaced apart in a substantially U-shaped configuration;

a through aperture formed in the grinding tool yoke;

the work piece yoke defined by a pair of spaced apart uprights with a channel formed therebetween;

a drive shaft configured to slide through the aperture in an axial direction across the space to the work piece yoke and rotate in either direction relative to the aperture of the grinding tool yoke and remain in a same axial position relative to a work piece;

a tool head connected to one end of the shaft;

an actuator member connected to another end of the shaft; and a biasing member engaged around the shaft between the grinding tool yoke and the tool head, the biasing member operable to urge the tool head toward the work piece yoke.

21. The apparatus of claim 20 further comprising:

a work piece collet having a wall with a flange extending therefrom, wherein the work piece collet is connectable with the work piece yoke when slidingly engaged within the channel and the flange abuts a face of at least one of the uprights.

22. The apparatus of claim 20, wherein the actuator member includes one of a hand gripable configuration and a rotary tool adaptor.

23. The apparatus of claim 20, wherein the tool head is configured to grind a flared surface of a fluid conduit.

24. The apparatus of claim 23, wherein the fluid conduit is one of a tube with a flared end and a male fitting with a flared end.

25. The apparatus of claim 20 further comprising:

a centering rod extending from the tool head opposite from the drive shaft.

26. The apparatus of claim 20 further comprising:

a tool head guide for guiding an outer surface of the tool head into alignment with the work piece, the tool head guide having a cylindrical inner wall with a threaded portion engageable with a threaded portion of a fitting and a non-threaded portion engageable with an outer wall of the tool head.

27. The apparatus of claim 20 further comprising:

a lock button extending through the grinding tool yoke and engageable with the drive shaft to lock the drive shaft in a retracted position.

28. A surfacing tool comprising:

an elongate base having a length defined in a first direction and a width defined in a second direction normal to the first direction, the elongate base including first and second yokes extending therefrom spaced apart in a substantially U-shaped configuration, wherein a distance of a space between the first and second yokes in the second direction is greater than the width of the elongate base;

an aperture extending through the first yoke and a collet holding region formed with the second yoke, the collet holding region defined by a pair of spaced apart uprights with a channel formed therebetween;

a grinding tool having an elongate shaft slidingly and rotatably engageable through the aperture of the first yoke;

a grinding tool head connected to one end of the elongate shaft; and a hand operated actuator connected to the other end of the elongate shaft operable to transmit rotational motion and axial sliding motion to the shaft.

29. The surfacing tool of claim 28 further comprising a biasing member positioned about the elongate shaft.

30. The surfacing tool of claim 28 further comprising a work piece collet having a wall with a flange extending therefrom, wherein the work piece collet slidingly engages within the channel and the flange abuts a face of at least one of the uprights of the collet holding region.

31. An apparatus comprising:

a fixture having a grinding tool yoke and a work piece yoke spaced apart in a substantially U-shaped configuration;

a through aperture formed in the grinding tool yoke;

a pair of spaced apart uprights with a channel formed therebetween defining the work piece yoke;

a drive shaft configured to slide through the aperture in an axial direction across the space to the work piece yoke and rotate relative to the aperture of the grinding tool yoke;

a tool head connected to one end of the shaft;

an actuator member connected to an opposing end of the shaft configured to transmit rotational motion and axial sliding motion to the tool head for surfacing a work piece; and a biasing member engaged about the drive shaft.

32. The surfacing tool of claim 31 further comprising a work piece collet engageable with the uprights of the collet holding region.

33. The surfacing tool of claim 32, wherein the work piece collet includes a flange extending therefrom configured to abut a face of at least one of the uprights when positioned in the collet holding region.

* * * * *